US005453155A

United States Patent [19]

Hung

[11] Patent Number: 5,453,155

[45] Date of Patent: Sep. 26, 1995

[54] METHOD OF MANUFACTURING A HOT-STAMPED DECAL

[76] Inventor: Chao-I Hung, No. 6, Twelfth Rd., Industrial Dist., Taichung City, Taiwan

[21] Appl. No.: 284,351

[22] Filed: Aug. 2, 1994

[51] Int. Cl.[6] ..... B44C 1/22; C23F 1/02

[52] U.S. Cl. ..... 216/41; 216/100

[58] Field of Search ..... 156/630, 631, 156/634, 656, 659.1, 902; 252/79.2, 79.4, 79.5

[56] References Cited

U.S. PATENT DOCUMENTS 2,711,983 6/1955 Hoyt ..... 156/902 X 2,731,333 1/1956 Ko et al. ..... 156/659.1 X

*Primary Examiner*—William Powell

*Attorney, Agent, or Firm*—Hamilton, Brook, Smith & Reynolds

[57] ABSTRACT

A method of manufacturing a hot-stamped decal includes at least four steps which are:

a. to prepare a metalized polyester film comprising a metalized layer disposed on a top surface thereof, a clear polyester sheet disposed to an under side of the metalized layer, an adhesive layer disposed to an under side of the clear polyester sheet and a release sheet disposed to an under side of the adhesive layer;

b. to execute a printing process on the metalized layer to form a mark thereon composed of a printed ink layer;

c. to mop the printed ink layer with an alkaline erodent solution to erode a top surface of the metalized layer not covered by the printed ink layer; and d. a neutralization reaction is executed by mopping an acid solution on the metalized layer after the metalized layer is eroded completely.

1 Claim, 1 Drawing Sheet

METHOD OF MANUFACTURING A HOT-STAMPED DECAL

BACKGROUND OF THE INVENTION

The present invention relates to a method of manufacturing a hot-stamped decal and more particularly, to a method using a metalized polyester film on which is executed a printing process in order to get a feature of a multi-colored hot-stamped decal.

Generally, a conventional hot-stamped decal is manufactured as shown in FIG. 1, wherein an embossed plate 90 made of zinc is prepared in which a desired mark is defined, the embossed plate 90 is covered with a hot stamped-film 91 and a heat pressing process is executed thereto to form the mark on the hot-stamped film 91 and then a clear polyester sheet 92 is connected to the hot-stamped film 91 and the mark shows through the clear polyester sheet 92. When using the hot-stamped decal, one just removes the clear polyester sheet 92 from the hot-stamped film 91 and adheres the hot-stamped film 91 to a desired object.

However, the embossed plate made of zinc is very expensive and the changes of temperature tend to alter its size, so that it cannot produce an exquisite hot-stamped decal. Furthermore, it is difficult to include multiply colors in the hot-stamped film and thus a complicated process is needed which thereby restricts its usage.

The present invention intends to provide an easier method to produce a cheap and multi-colored hot-stamped decal to mitigate and/or obviate the above-mentioned problems.

SUMMARY OF THE INVENTION

The present invention provides a method of manufacturing a hot-stamped decal including at least four steps which are:

a. to prepare a metalized polyester film which is composed of a metalized layer, a clear polyester sheet, an adhesive layer, a clear polyester and a release sheet disposed in sequence;

b. to execute a printing process on the metalized layer to form a mark thereon composed of a printing ink layer;

c. to mop the printing ink layer with an alkaline eroding solution to erode a top surface of the metalized layer 11 not covered by the printing ink layer; and d. a neutralization reaction is executed by mopping an acid solution on the metalized layer after the metalized layer is eroded completely.

It is an object of the present invention to provide a method using a printing technology onto the metalized layer and using an erosion action to etch a mark on the metalized layer such that the present invention provides a hot-stamped decal with multiple colors that is easily made.

Other objects, advantages, and novel features of the invention will become more apparent from the following detailed description when taken in conjunction with the accompanying drawings.

DETAILED DESCRIPTION OF PREFERRED EMBODIMENT

Figure 1:
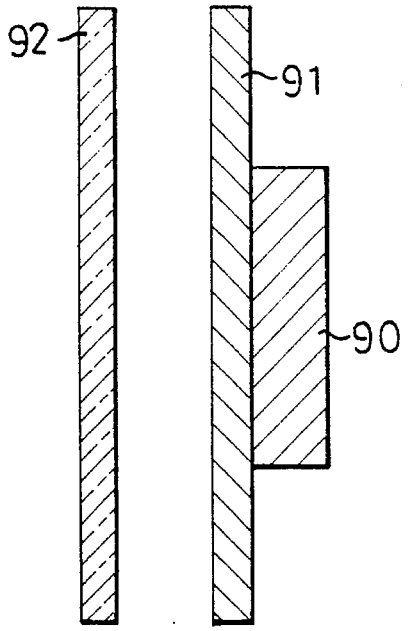
FIG. 1 PRIOR ART
FIG. 1 is a schematic view of a manufacturing process of a conventional hot-stamped film.
Figure 2:
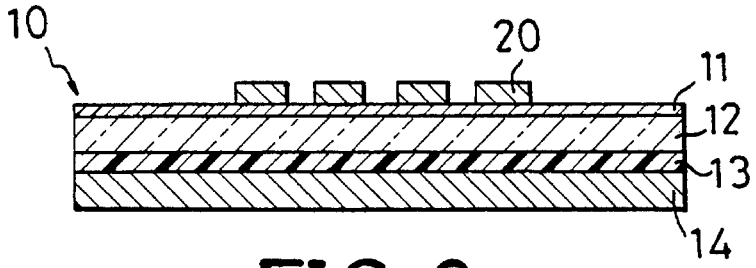
FIG. 2 is a side elevational view in section of a specialty metalized polyester film after printing a mark thereon in accordance with the present invention.
Figure 3:
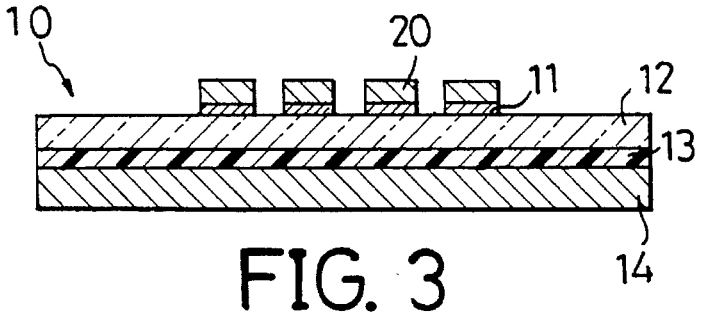
FIG. 3 is a side elevational view in section of the specialty metalized polyester film after executing an erosion process thereon.

Referring to the drawings and initially to FIGS. 2 and 3, a method of manufacturing a hot-stamped decal in accordance with the present invention generally includes the following steps:

a. to prepare a metalized polyester film 10 which comprises a metalized layer 11 disposed on a top surface thereof, a clear polyester sheet 12 disposed to an under side of the metalized layer 11, an adhesive layer 13 disposed to an under side of the clear polyester sheet 12 and a release sheet 14 disposed to an under side of the adhesive layer 13;

b. to execute a printing process on the metalized layer 11 to form a mark thereon composed of a printed ink layer 20;

c. to mop the printed ink layer 20 with an alkaline eroding solution to erode a top surface of the metalized layer 11 not covered by the printed ink layer 20; and d. a neutralization reaction is executed by mopping an acid solution on the metalized layer 12 after the metalized layer 11 is eroded completely to stop the erosion action.

Accordingly, because the method in accordance with the present invention uses the printing technology on the metalized layer 11, the mark formed on the metalized layer 11 can be variable and has multiple choices of colors.

Although the invention has been explained in relation to its preferred embodiment, it is to be understood that many other possible modifications and variations can be made without departing from the spirit and scope of the invention as hereinafter claimed.

I claim:

1. A method of manufacturing a hot-stamped decal, comprising:

a. preparing a metalized polyester film comprising a metalized layer disposed on a top surface thereof, a clear polyester sheet disposed to an under side of said metalized layer, an adhesive layer disposed to an under side of said clear polyester sheet and a release sheet disposed to an under side of said adhesive layer;

b. executing a printing process on said metalized layer to form a mark thereon composed of a printed ink layer;

c. mopping said printed ink layer with an alkaline erodent solution to erode said top surface of said metalized layer not covered by said printing ink layer; and d. a neutralization reaction being executed by mopping an acid solution on the metalized layer after said metalized layer is eroded completely.

* * * * *